US006231453B1

(12) United States Patent
Jebe

(10) Patent No.: US 6,231,453 B1
(45) Date of Patent: May 15, 2001

(54) GOLF SWING INDICATOR

(76) Inventor: Arnim B. Jebe, 67 Blue Spruce Cir., Weston, CT (US) 06883

( * ) Notice: Subject to any disclaimer, the term of this patent is extended or adjusted under 35 U.S.C. 154(b) by 0 days.

(21) Appl. No.: 09/398,283

(22) Filed: Sep. 20, 1999

Related U.S. Application Data

(60) Provisional application No. 60/103,637, filed on Oct. 9, 1998.

(51) Int. Cl.[7] ..... A63B 69/36
(52) U.S. Cl. ..... 473/233
(58) Field of Search ..... 473/233, 219, 473/223, 226, 231, 234, 305, 306, 307, 308, 309, 310, 315

(56) References Cited

U.S. PATENT DOCUMENTS

| | | | | |
|---|---|---|---|---|
| 1,895,417 | * | 1/1933 | Lard | 473/315 |
| 2,018,723 | * | 10/1935 | Hutchison | 473/315 |
| 2,543,722 | * | 2/1951 | Hetzel | 473/233 |
| 2,780,098 | | 2/1957 | Maroth | 473/233 |
| 2,986,937 | * | 6/1961 | Chapman | 473/233 |
| 3,733,077 | * | 5/1973 | Fennell | 473/233 |
| 4,270,753 | | 6/1981 | Maroth et al. | 473/233 |
| 4,363,488 | | 12/1982 | Maroth et al. | 473/233 |
| 4,684,133 | | 8/1987 | Maroth | 473/233 |

* cited by examiner

*Primary Examiner*—Steven Wong
(74) *Attorney, Agent, or Firm*—William C. Crutcher

(57) ABSTRACT

Improved push button release for a centrifugal golf swing indicator which releases the indicator weight when the push button is depressed, and resets the golf swing indicator for the next use when the release button is released. Further improvements include a pair of opposed C-clamp attachments and an indicator for the indicator weight.

5 Claims, 3 Drawing Sheets

GOLF SWING INDICATOR

CROSS REFERENCE TO RELATED APPLICATIONS

Figure 1:
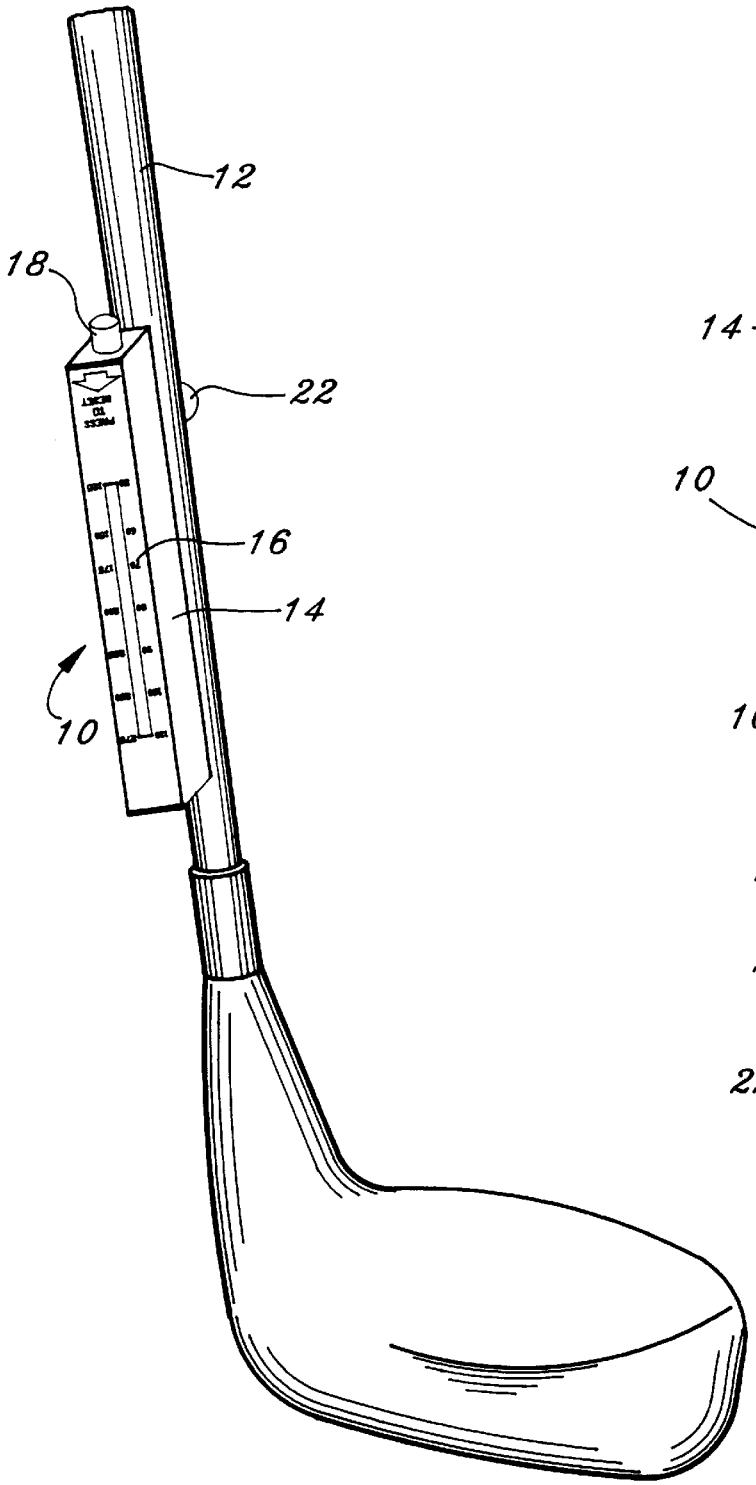

This application claims the benefits of prior filed, co-pending provisional application Ser. No. 60/103,637 filed Oct. 9, 1998.

This invention relates generally to an accelerometer device for measuring the swing imparted to a golf club, and more particularly to an improved golf swing indicator especially adapted for attachment to a golf club shank with improved resetting of the device after measuring the swing.

BACKGROUND OF THE INVENTION

A basic type of indicating gauge responsive to circular or angular velocity for attachment to sports equipment is shown in U.S. Pat. No. 2,780,098. There an elongated housing contains a rotatable shaft with ratchet teeth and a slidable indicator with a pawl engaging the ratchet teeth to hold the indicator against the biasing force of a compression spring. A separate weight is slidable along the shaft and restrained from movement toward the indicator by a tension spring. The housing is attached to a piece of sports equipment, such as a tennis racket . Centrifugal force of the swing causes the weight to slide along the shaft and displace the indicator which, in turn, is retained by the pawl and ratchet teeth, while the weight returns to its former position. A push button release with pin and cam slot cause the shaft to rotate and return the indicator.

A later disclosed golf swing indicator is shown in U.S. Pat. No. 4,270,753 in which the slidable indicator and slidable weight are combined into a single member rather than separate members. The release mechanism employed a torsion spring to resist the turning of the shaft by an external knob, so as to release the pawl from the ratchet teeth and allow the combined weight and indicator member to return to its zero position. C-clamps with thumb screws were attached to the housing for enabling attachment to the shank of a golf club.

A still later golf swing indicator is disclosed in U.S. Pat. No. 4,684,133, in which a detent structure acting between the shaft and the housing was substituted for the torsion spring of U.S. Pat. No. 4,270,753. This requires using an external knob to first rotate the shaft in one direction to release the indicator and then in the other direction to reset the pawl on the ratchet teeth. While this eliminates a torsion spring, it results in a cumbersome resetting procedure. The C-clamps with thumb screws also represent an attachment method which has the possibility of damaging the golf club shank by over-tightening the thumb screws.

It would be desirable to have an improved release mechanism assembly suitable for a golf swing indicator of the type described.

It would also be desirable to have an improved push button release mechanism for a golf swing indicator of the type described, which automatically releases and resets the indicator after each use with one push.

It would also be desirable to have an improved structure for attaching the indicator housing to the shank of a golf club.

It would also be desirable to have an improved slidable indicator weight and spring pawl attachment.

SUMMARY OF THE INVENTION

Briefly stated the invention comprises improvements in a golf swing indicator for attachment to a golf club shank, the golf swing indicator being of a known type having an elongated housing, an elongated shaft rotatable within the housing, the shaft having a row of teeth and a smooth section alongside the row of teeth, a combined indicator and centrifugal weight (indicator weight) slidable along the shaft, a spring pawl mounted on the indicator weight and adapted to engage the teeth when the shaft is rotated to a first position and to slide on the smooth section of the shaft when the shaft is rotated to a second position, a first spring biasing the indicator weight toward a first end of the shaft.

An improved release mechanism for the above known golf swing indicator comprises a cylindrical bushing mounted on the first end of the elongated shaft, the bushing having a radial cam pin integral therewith, a release button having a cylindrical bore arranged to slidably and rotatably receive the bushing, and having a cam slot receiving the cam pin, a release button housing mounted in the main housing arranged to slidably receive the release button and having means preventing rotation of the release button, the cam slot being arranged to rotate the cam pin and shaft from the first shaft position to the second shaft position when the release button is pushed by an operator, and a release return spring (second spring) adapted to return the release button when it is no longer being pushed, so as to cause the cam slot to rotate the cam pin and shaft from the second position back to the first position.

An improved attachment for the golf club swing indicator comprises a pair of resilient C-clamp members attached to the housing and adapted to receive a golf club shank, the C-clamps being oriented in opposite lateral directions so that the golf club shank is engaged by twisting the swing indicator housing. The C-clamps include retaining buttons holding the shank against cushion pads mounted in the main housing.

An improved spring pawl and indicator weight attachment structure comprises a slot in the spring pawl and a projection on the indicator weight which extends through the slot to fix the location of the pawl, as well as to serve as a visible indicator mark to match against indicia on the main housing indicating the effectiveness of the golf swing.

DRAWING

Figure 2:
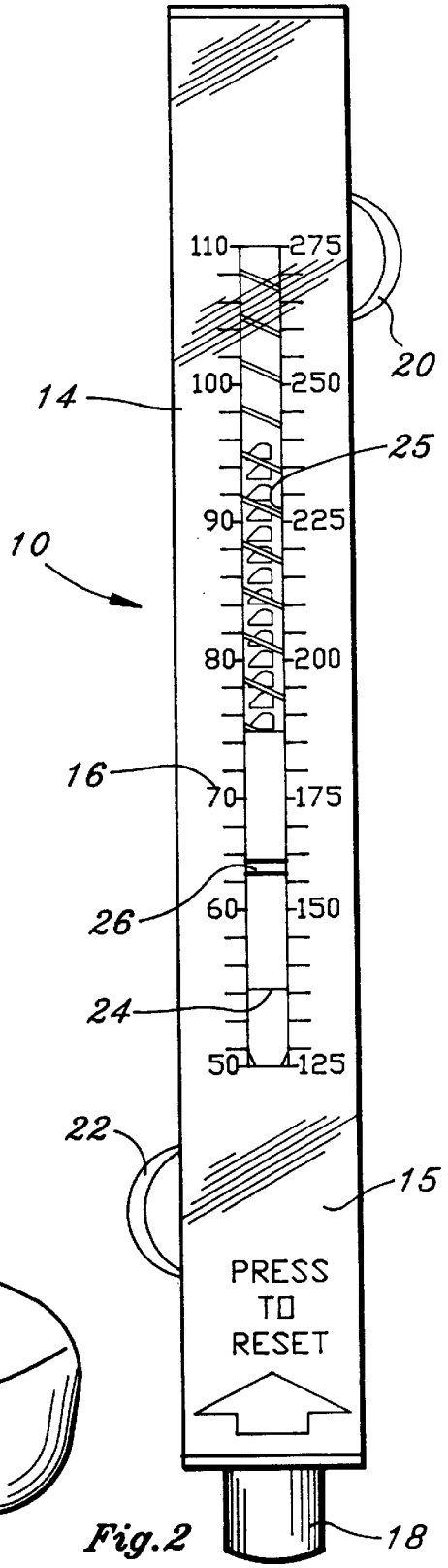
Figure 3:
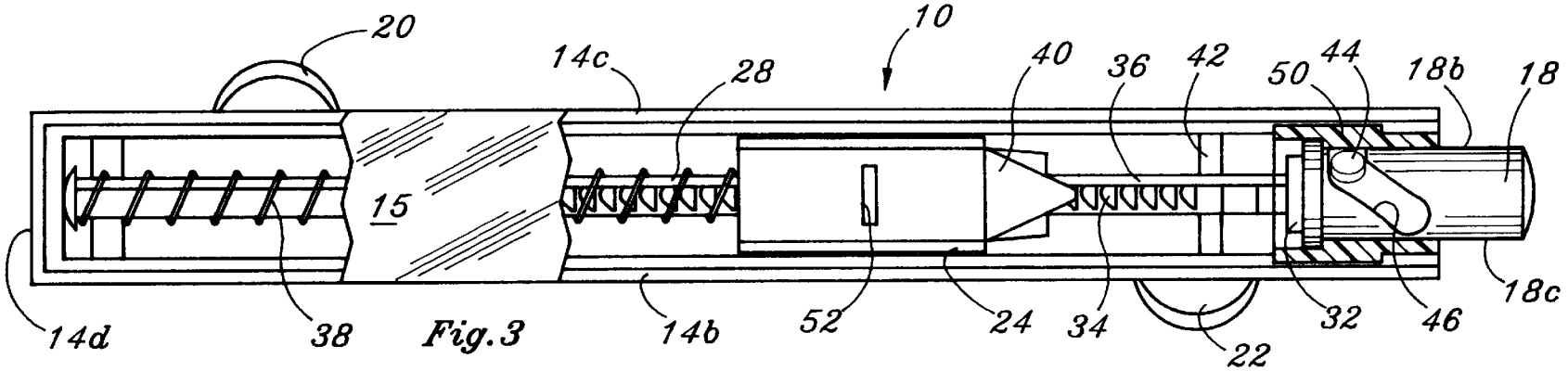
Figure 4:
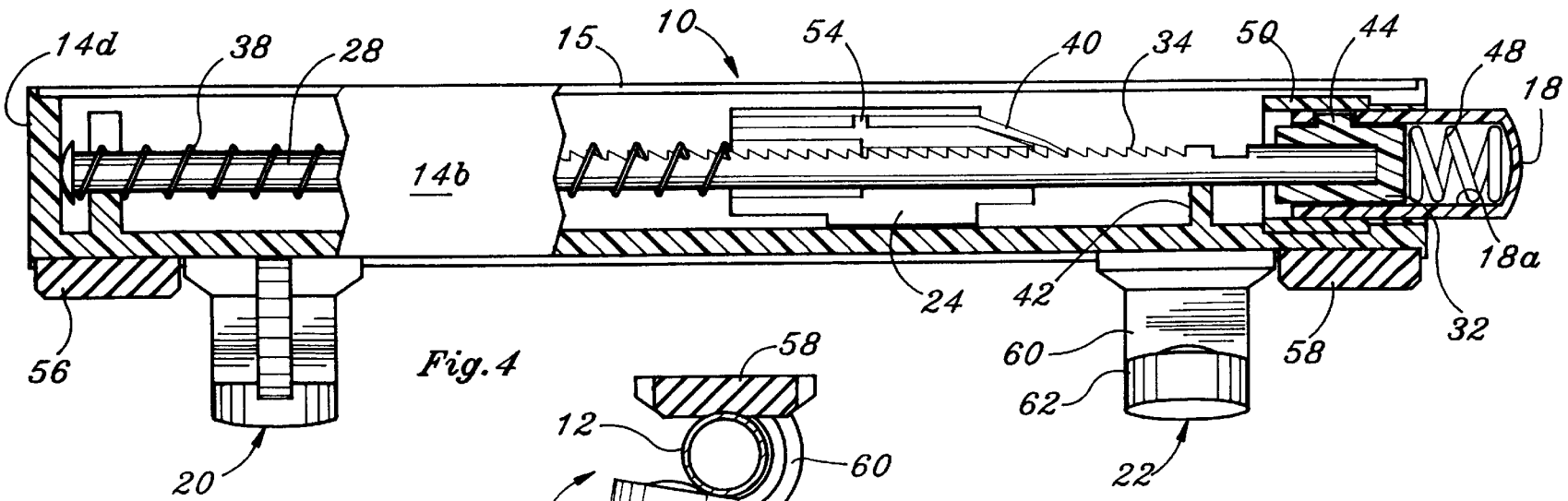
Figure 5:
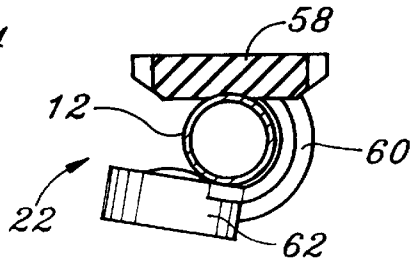
Figure 6:
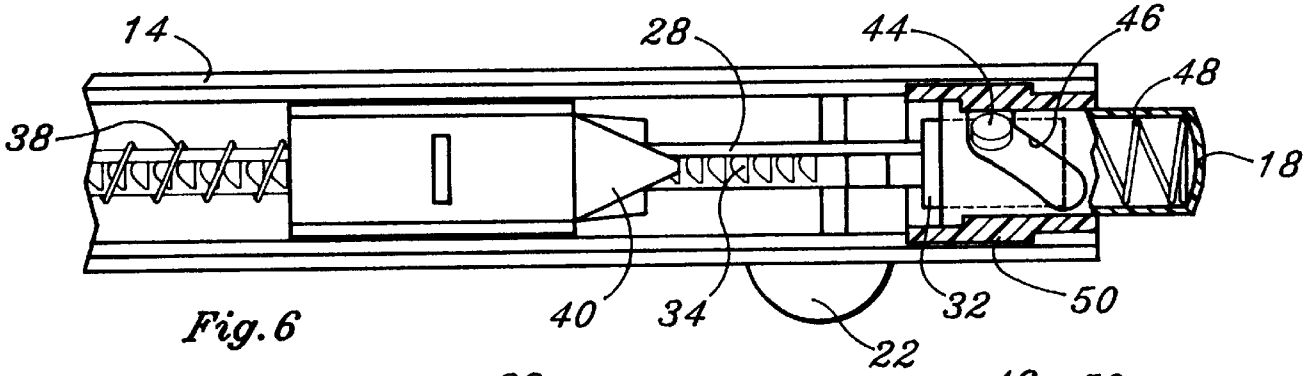
Figure 7:
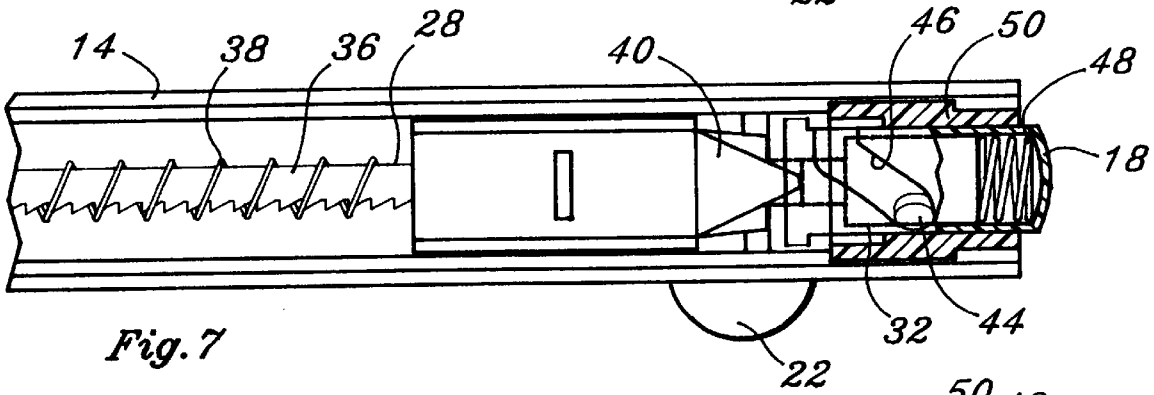
Figure 8:
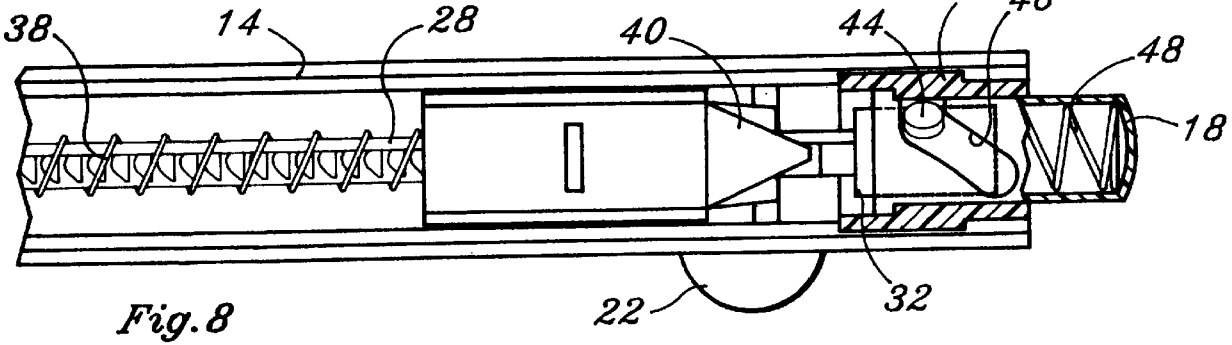

The invention will be better understood by reference to the following description, taken in connection with the accompanying drawing, in which:

FIG. 1 is a perspective view of the golf swing indicator attached to the golf club shank, FIG. 2 is a top plan view of the golf swing indicator, FIG. 3 is the same top plan view of the golf swing indicator with portions of the cover removed and partly in section to disclose the indicator weight and release mechanism, FIG. 4 is a side elevational view with portions of the housing removed to disclose the release mechanism, weight indicator and attachment clamps, FIG. 5 is an end elevation view detail of one of the attachment clamps, FIG. 6 is an enlarged top plan view of the indicator weight after displacement of the indicator weight and before the release button is pressed, FIG. 7 is the same view as FIG. 6, after the release button is pushed to rotate the shaft and release the indicator weight, and FIG. 8 is the same view as FIGS. 6 and 7 after the release button has been released to reset the mechanism.

DESCRIPTION OF THE PREFERRED EMBODIMENT

Referring to FIG. 1 of the drawing, a golf swing indicator shown generally as 10 is adapted for attachment to a shank 12 of a golf club near the head of the club. The golf swing indicator comprises an elongated housing 14 with an indicator weight to be described, which is subjected to centrifugal force of the golf club. The housing has indicia 16 marked on one face thereof to indicate the speed of the club swing and/or the distance traveled by the ball, and a release button 18 which resets the mechanism. The indicia are inverted so that they can be read by the operator.

Referring to FIG. 2 of the drawing, golf swing indicator 10 is illustrated in greater detail in the plan view, with indicia 16 in a readable position. Resilient C-clamps 20, 22 extending laterally in opposite directions from housing 14 serve to attach the housing 14 to the shank 12. One of these may be seen in FIG. 1, the other one being obscured from view.

A spring-biased indicator weight 24 with an indicating mark 26 may be seen through a transparent window 25. As in known prior art golf swing indicators, indicia 16 may be marked off in an arbitrary scale indicating club head speed and may also be marked off in yards theoretically achieved by the golf ball when struck by the golf club.

Referring to the partial cross section views of FIGS. 3 and 4 of the drawing, many of the details of the golf swing indicator 10 are similar to those of prior art devices mentioned in the Background of the Invention, but will be described for completeness of the description.

An elongated housing 14 of plastic material comprises a bottom wall 14*a*, side walls 14*b*, 14*c* and an end wall 14*d*. The top of the housing is closed by a transparent cover piece 15, on which the indicia are inscribed or provided using a decal (FIG. 2). An elongated shaft 28 extends through the center of housing 14 and is rotatably mounted therein. One end of the shaft 28 is supported in an internal bearing 30. The other end of shaft 28 is inserted into a special bushing 32, which is rotatably mounted in a cylindrical bore 18*a* of the release button 18.

The elongated shaft 28 includes a row of teeth 34 extending along the shaft and a smooth section 36 alongside the row of teeth. The indicator weight 24 is adapted to slide along the elongated shaft 28 inside the housing, and is biased toward the right hand side of the drawing by means of a compression spring (first spring) 38. The spring constant of compression spring 38 and the weight of the indicator weight 24 are carefully selected with respect to one another so that a known acceleration due to centrifugal force will move the indicator weight 24 (toward the left hand side of the drawing) by a predetermined linear displacement.

A spring pawl 40 includes a tip end which engages teeth 34 in a first rotatable position of shaft 28. This prevents the return of the indicator weight 24. When shaft 28 is rotated to a second position, the tip of pawl 40 engages the smooth portion 36 of shaft 28. This allows the indicator weight 24 to move to the right under the force of compression spring 38 until it reaches a stop 42 incorporated in housing 14 for this purpose. The foregoing details are known in the prior art.

The release mechanism assembly will now be described. Bushing 32 is rotatably mounted within the cylindrical bore 18*a* of the release button 18. Bushing 32 includes a radial cam pin 44 which extends into a cam slot 46 in the side of the release button wall. A release return spring 48 (second spring) is interposed between the end of bushing 32 and the closed end of release button 18. The release button 18 is slidably mounted within a release button housing 50 which is mounted in the end of housing 14. The release button has flat sides 18*b*, 18*c*, so that it is constrained to move longitudinally in the release button housing 50 without rotating. Therefore, when release button 18 is pressed so that it moves longitudinally to the left, the cam slot 46 requires the radial cam pin 44 to rotate shaft 28. The rotation is such that the row of teeth 34 is disengaged from the end of pawl 40 to allow pawl 40 to engage the smooth section 36 of shaft 28. This releases the indicator weight 24 and allows the indicator to reset. Release of the release button 18 enables the compression spring 48 to move the release button in a longitudinal direction, thereby constraining the shaft 28 to return to its previous position.

The foregoing sequence of events is depicted in the partial views of FIGS. 6, 7 and 8. FIG. 6 indicates the indicator weight 24 after it has moved to the left by centrifugal force of the golf swing and held by the ends of pawl 40 pressing against teeth 34.

FIG. 7 illustrates release button 18 depressed against compression spring 48. Cam slot 46 has caused the bushing radial cam pin 44 to rotate the bushing 32 and shaft 28 to a second shaft position, which releases indicator 24.

FIG. 8 illustrates how compression spring 48 returns release button 18 to its previous position. When this occurs, cam slot 46 causes cam pin 44 to rotate bushing 32 and shaft 28 to their previous positions, thereby resetting the mechanism.

Another feature of the invention is the use of the spring pawl attachment as an indicator mark. Referring to FIGS. 3 and 4 of the drawing, spring pawl 40 is of metal and includes a slot 52 on the flat top section of the pawl. The indicator weight 24 comprises a plastic housing with an upstanding rectangular tab 54 of a color distinguishable from that of the metal pawl 40. The dimensions of the two members are such that the pawl 40 can be snapped in place with the slot 52 fitting tightly over the exposed end of the ridge 54. This provides a visual indicator to use in connection with the indicia and also holds the pawl to the indicator weight.

Another important feature of the invention is the manner in which the housing is attached to the shank. Referring to FIGS. 3, 4 and 5 of the drawing, the resilient C-clamps 20, 22 are seen to extend laterally in opposite directions. Elastomeric cushions 56, 58 are attached to the bottom wall 14*a* of the housing and arranged adjacent the clamps. Each of the clamps, as seen in FIG. 5, includes a resilient or flexible wall 60 and a connected pressure pad 62 incorporating a hard retaining button 64. Thus when the golf club shank 12 is pressed against the clamp, it will snap over the retaining button 64 and be held by the resilient wall 60 of the clamp against the cushion 58.

An important feature of the invention is the disposition of the lateral openings of clamps 20, 22 so that they face in opposite directions. In this manner, rather than pushing the shank against two clamps facing the same direction, the housing can be applied with a twisting motion resulting in greater ease of attachment than in the previous golf swing indicators.

What is claimed is:

1. An improved golf swing indicator adapted for attachment to a golf club shank, the golf swing indicator being of a known type having an elongated housing having indicia thereon, an elongated shaft rotatable within the housing, the shaft having a row of teeth and a smooth section alongside the row of teeth, an indicator weight adapted to slide along the shaft, a spring pawl mounted on the indicator weight and adapted to engage the teeth when the shaft is rotated to a first position and to slide on the smooth section of the shaft when the shaft is rotated to a second position, and a first spring biasing the indicator weight toward a first end of the shaft, said improved golf swing indicator comprising:

a cylindrical bushing mounted on said first end of the elongated shaft, said bushing having a radial cam pin, a release button having a cylindrical bore arranged to slidably and rotatably receive the bushing and having a cam slot receiving said radial cam pin, a release button housing mounted in said elongated housing arranged to slidably receive the release button and having means preventing rotation of the release button, said cam slot being arranged to rotate the cam pin and shaft from the first shaft position to the second shaft position when the release button is pushed by an operator, and a release button return spring adapted to return the release button when it is no longer being pushed, whereby the return movement of the release button causes the cam slot to rotate the cam pin and shaft from the second position back to the first position, and an improved attachment for the golf club swing indicator comprising a pair of resilient C-clamp members attached to said elongated housing and dimensioned to receive and frictionally hold said elongated housing parallel to said golf club shank, the C-clamps being oriented in opposite lateral directions with respect to the elongated housing so that the golf club shank is engaged by twisting the swing indicator housing with respect to the golf club shank.

2. The improvement according to claim 1, wherein said release button return spring is a compression spring disposed in said cylindrical bore of the release button and arranged to bias the release button away from said cylindrical bushing.

3. The improvement according to claim 1, wherein the rotation preventing means for the release button comprises matching flat side surfaces on the release button and the release button housing.

4. Improvement according to claim 1, including cushion pads mounted in the elongated housing, and wherein said C-clamps include retaining buttons holding said golf club shank against said cushion pads.

5. Improvement according to claim 1 and further including an improved indicator for said indicator weight comprising a slot defined in said spring pawl and a projection on said indicator weight which extends through the slot to fix the location of the pawl, as well as to serve as a visible indicator mark to match against said indicia on the elongated housing, so as to indicate the effectiveness of the golf swing.

* * * * *